United States Patent [19]

Hudson et al.

[11] Patent Number: 4,599,878

[45] Date of Patent: Jul. 15, 1986

[54] BENDING AND STRAIGHTENING APPARATUS

[75] Inventors: Michael J. Hudson, West Bridgford; John C. Sinclair, Willington, both of United Kingdom

[73] Assignee: The Permanent Way Equipment Company Limited, United Kingdom

[21] Appl. No.: 601,498

[22] Filed: Apr. 18, 1984

[30] Foreign Application Priority Data

Apr. 23, 1983 [GB] United Kingdom ..... 8311095
Apr. 23, 1983 [GB] United Kingdom ..... 8311111

[51] Int. Cl.[4] ..... B21B 37/08

[52] U.S. Cl. ..... 72/19; 72/21; 72/31; 72/390

[58] Field of Search ..... 72/11, 19, 21, 31, 386, 72/387, 388, 389, 381, 390

[56] References Cited

U.S. PATENT DOCUMENTS 1,129,650 2/1915 Dean ..... 72/390
1,777,686 10/1930 Bagge ..... 72/389
1,796,696 3/1931 Trimble ..... 72/389
2,180,157 11/1939 Loftus ..... 72/373
2,434,254 1/1948 Benner ..... 72/390
3,713,312 1/1973 Galdabini ..... 72/389
4,408,471 10/1983 Gossard et al. ..... 72/21

FOREIGN PATENT DOCUMENTS 625109 8/1961 Canada ..... 72/390

*Primary Examiner*—Francis S. Husar
*Assistant Examiner*—David B. Jones
*Attorney, Agent, or Firm*—Thomas W. Speckman

[57] ABSTRACT

The method and apparatus are for bending or straightening a material such as a rail. A simple form of the apparatus comprises two spaced contact members for contacting the rail, and a rail lifting member located between these points arranged to lift the rail between the two points, the lifting member being arranged to engage the head of the rail. A preferred method comprises applying a load to the material and, while the load is applied, continuously or periodically measuring the load applied and the displacement of the material relative to the datum, establishing from the measurements a load at which the plastic component of the total deformation measured is equal to the predetermined deformation from the datum, and then removing the load.

11 Claims, 8 Drawing Figures

BENDING AND STRAIGHTENING APPARATUS

BACKGROUND OF THE INVENTION

1. Field of the Invention

This invention relates to a method of and apparatus for bending or straightening a material having both elastic and plastic characteristics. The method and apparatus are particularly suitable for use in straightening rail but can be used in other applications.

2. Description of the Prior Art

Downwardly-directed deflections or bends in rails forming part of railway line can arise for example through imperfect finishing of welds with a high volume of traffic over the rail. To give a smooth ride for a train over the rail, the rail requires straightening in situ, and such straightening is typically carried out using a three-point rail straightening apparatus having two spaced contact points on the rail and a rail lifting member between these points, the rail lifting member being arranged to lift a bar inserted beneath the rail. A disadvantage of this arrangement is that it is necessary to clear away ballast from beneath the rail before the bar can be inserted, and the ballast must be restored after the rail has been straightened. This adds to the time taken for each straightening operation.

SUMMARY OF THE INVENTION

According to one aspect of the present invention we provide a three-point rail-straightening apparatus comprising two spaced contact members for contacting the rail, and a rail lifting member located between these points arranged to lift the rail between the two points, the lifting member being arranged to engage the head of the rail.

In a preferred embodiment of the invention, a three-point rail-straightening apparatus comprises spaced first and second rail-engaging members adapted to bear on the upper surface of a rail, a third rail-engaging member therebetween, and a beam coupling the three rail-engaging members together, at least one of the rail-engaging members comprising loading means for applying a force between the beam and the rail, wherein the third rail-engaging member comprises gripping means engageable on the rail-head whereby the rail may be pulled upwardly by said third member.

According to another aspect of the invention, a method of bending a material to a predetermined deformation from a datum, the material being capable of both elastic and plastic deformation, comprises:

(a) applying a load to the material and, while the load is applied, continuously or periodically measuring the load applied and the displacement of the material relative to the datum, (b) establishing from the measurements a load at which the plastic component of the total deformation measured is equal to the predetermined deformation from the datum, and then removing the load.

In a preferred method of the invention, the load is increased continuously up to the point at which it is removed, and step (b) comprises establishing from the measurements of load and displacement obtained a linear function relating the load to displacement during elastic deformation, comparing the measured displacement for each measurement of the load with the value of the displacement predicted for the measured load using the linear function, and removing the load when the difference between the measured and predicted displacements is substantially equal to the desired permanent displacement or deformation relative to the datum.

Another aspect of the invention provides apparatus for bending a material to a predetermined deformation from a datum, the material being capable of both elastic and plastic deformation, comprising:

(a) loading means for applying a load to the material;

(b) load-measuring means for generating a signal representing the load applied to the material by the loading means;

(c) displacement-measuring means for generating a signal representing the displacement of the material relative to the datum;

(d) sampling means for periodically sampling the signals generated by the load-measuring means and displacement-measuring means;

(e) processing means arranged (i) to detect from the samples supplied by the sampling means those samples which are obtained below the elastic limit for the material, (ii) to derive therefrom a linear function relating the load to displacement under elastic deformation, (iii) to calculate for each subsequent sample using the function derived a predicted value of the displacement for the measured load, and (iv) to generate a control signal when the difference between the measured displacement in a subsequent sample and the predicted value for the measured load in the said sample is substantially equal to the predetermined deformation, and (f) control means responsive to the control signal to cancel the operation of the loading means.

Alternatively, (iii) and (iv) of (e) above can be replaced by:

(iii) to derive from the linear function a second linear function relating to load to the sum of displacement due to elastic deformation and the desired predetermined deformation from the datum;

(iv) to test each subsequent sample by substitution of the measured load in the second linear function to obtain a calculated displacement; and (v) to generate a control signal when the measured and calculated displacements for the measured load are substantially equal.

These features have the same practical effect as (iii) and (iv) of (e) above.

It will be appreciated that instead of direct measurements of the load in the method and apparatus of the invention, measurements may be made of any other characteristic which is a function of the load, and these measurements may be used without conversion to direct values of load.

The method and apparatus of the invention may be used to bend a material to a predetermined deformation which is in excess of the desired final deformation, and then the operation may be repeated but with the load applied in the opposite direction such that when the load is released the material relaxes its elastic deformation to return to the desired final deformation. In this way, a more favorable residual stress may be achieved, the amount of overbending beyond the desired deformation being determined in advance by experiment or prediction from the properties of the material.

The method and apparatus of the invention are applicable not only to metals, particularly steel, but also to some plastics and wood, and more generally to any materials where plastic deformation follows an initial deformation due purely to the elastic properties of the material following Hooke's Law.

One suitable application of the method and apparatus of the invention is in the straightening of rails for or in use in railway tracks. For example, in order that trains may run smoothly, vertical bends in the rails resulting from faulty manufacture or heavy traffic loading, for example, have to be removed. Rail straightening devices are typically of the three-point type, having a beam of about 1m in length spanning the bend in the rail. The beam has first and second rail-engaging members at its ends, which members bear on the upper surface of the rail, the second rail-engaging member consisting of a hydraulic jack. A third rail-engaging member is located between the first and second rail-engaging members and may be lifted by the beam. This third member includes a block which passes beneath the rail, whereby the rail may be lifted by the beam at the third member against reaction at the first and second members. Thus, extension of the jack results in a vertical deflection of the rail. Ideally, the jack should be operated until the plastic component of the total load applied by the the jack is equal to the permanent deformation needed to straighten the rail. Typically, however, the total load has been determined by trial and error, rendering the straightening of rails a lengthy process, requiring skilled personnel.

Thus, a preferred embodiment of the apparatus of the present invention provides a three-point rail straightening apparatus which comprises spaced first and second rail-engaging members, a third rail-engaging member therebetween, and a beam coupling the three rail-engaging members together, at least one of the rail-engaging members comprising loading means for applying a load between the beam and the rail, wherein the displacement-measuring means measures the displacement of the rail at the third rail-engaging member relative to the positions of the first and second rail-engaging members, and the load-measuring means measures the load applied to the rail.

Preferably the load-measuring means comprises a means for measuring the stress in the beam, for example a strain gauge on the upper surface of the beam. Alternatively, the loading means may incorporate a load cell.

The apparatus preferably comprises a microprocessor receiving measurements from the load- and displacement-measuring means in the form of electrical signals and sending control signals to control the operation of the loading means. Typically the loading means comprises a hydraulic jack, and the microprocessor sends a control signal to release the pressure in the jack when the desired deflection has been achieved. The microprocessor is programmed to determine the transition from elastic to plastic deformation of the bar. The deformation is a substantially linear function of the load applied in the elastic region, but a non-linear function in the plastic region of the deformation.

In an alternative embodiment of the apparatus of the invention, the measurements from the force- and displacement-measuring means may be displayed in a form to be read by an operator, for example by an x/y plotter, the operator determining the point at which the load is to be released.

The apparatus and method of the invention enable materials to be bent quickly and accurately in one continuous operation, without the need for precise information as to the dimensions and composition of the material. In the case of rails, vertical bends may be accurately straightened without the need for the operator to exercise exceptional skill.

BRIEF DESCRIPTION OF THE DRAWINGS

Reference is made to the drawings, in which.

DESCRIPTION OF THE PREFERRED EMBODIMENTS

Figure 1:
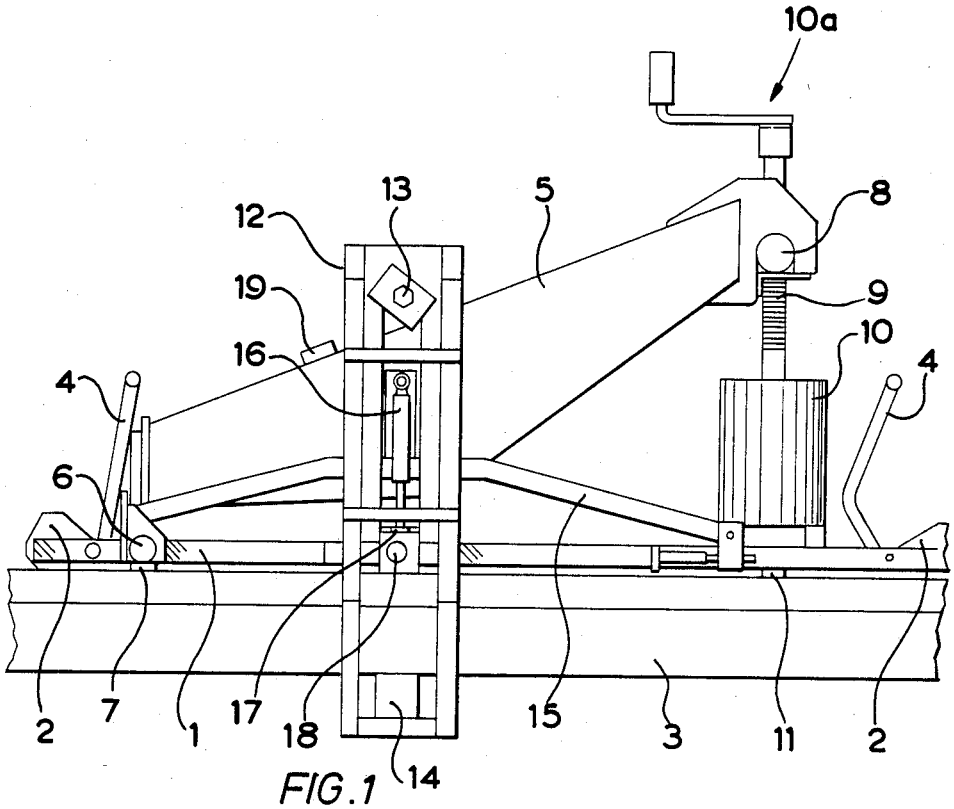
FIG. 1 is a side elevation of an apparatus in accordance with the invention, for straightening rails.
Figure 1A:
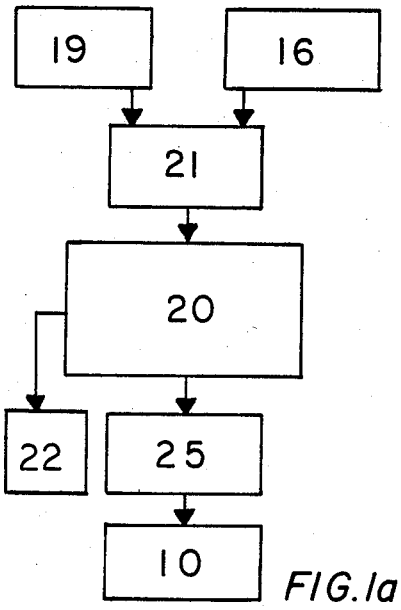
FIG. 1A is a schematic diagram of an apparatus of the present invention.

Referring to FIG. 1, the three-point rail-straightening apparatus comprises a support frame 1 having at each end thereof a transport roller 2 which can be pivoted on to the rail 3 by means of a handle 4, lifting the apparatus and enabling it to be drawn along the rail. The support frame 1 carries a main beam 5 which is linked to the frame 1 via a pivot 6 at one end of the beam and adjacent to one of the rollers 2. The beam 5 carries a foot 7 which rests on the rail 3 when the rollers 2 are raised. At the opposite end of the main beam 5, a pivot 8 links the beam to the shaft 9 of a hydraulic jack or ram 10 carried by the frame 1. A second foot 11 beneath the ram may also rest on the rail when the adjacent roller 2 is raised, thereby transmitting force to the rail. The jack 10 has a manually-operated screw adjustment **10*a*** to enable any movement to be taken up before the jack is extended.

Intermediate between the two ends of the beam 5 a lifting arm 12 is carried by the beam, force being transmitted from the beam 5 to the arm 12 by means of a cross-bar 13 resting on the upper surface of the beam. The lower part of the lifting arm 12 carries a lifting bar 14 which is inserted beneath the rail 3 and into a corresponding part of the lifting arm 12 on the opposite side of the apparatus (not shown).

In use, the jack is gradually extended by hydraulic pressure until the amount by which the lifting bar 14 has lifted the rail 3 relative to the feet 7 and 11 is sufficient to correct the downwardly-directed bend in the rail. In this respect the apparatus is similar to conventional three-point rail straightening apparatus.

A measuring bridge 15 extends the length of main beam 5 between a point adjacent to the foot 7 and the lower end of the hydraulic jack, adjacent to the foot 11, and carries a potentiometer 16 which is mounted within the lifting arm 12. The probe 17 of the potentiometer 16 extends downwardly and rests on a reference block 18 which in turn rests on the rail 3. A strain gauge 19 is mounted on the upper surface of the main beam 5. The output from the potentiometer 16 and the strain gauge 19, in the form of electrical signals, is fed to sampling means 21 periodically sampling the signals, and transmitting signals to a microprocessor 20, which is programmed to detect when the load applied is sufficient to cause a permanent set in the rail which will restore the rail to its unbent or other required condition and to transmit a control signal to control means 25 to cancel the operation of loading means 10. The measurements from the force- and displacement-measuring means may be displayed on an x/y plotter 22.

Figure 2:
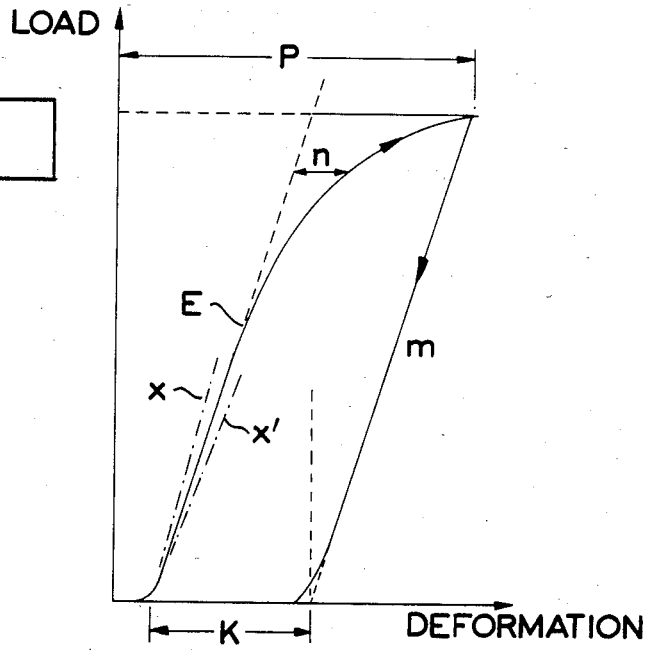
FIG. 2 is a graph of load applied against deformation for material such as a steel rail.

FIG. 2 is a graph showing load applied by the jack against measured deformation of the rail. The measurements of the strain gauge 19 may be used to represent the load applied, these measurements excluding the load absorbed in linkages between the jack and the beam 5, for example. The measurements of the potentiometer 16, may similarly be used to represent deformation of the rail. In the graph, the required permanent set in the rail, due to plastic deformation, is represented by k. As the load is increased, the deformation increases linearly until the elastic limit (E) is reached. At this point, the linear relationship between the load and the deformation breaks down, and further deformation results in both elastic and plastic deformation of the rail. The load is further increased until the plastic component n of the deformation is equal to the permanent deformation K. When this deformation is achieved, the load is released, the load/deformation relationship following the elastic line m to leave the required permanent rail deformation k.

It will be appreciated that different types of rail will exhibit different characteristics, each giving rise to a slightly different curve, as indicated by the chain-dotted lines x and x' in FIG. 2. The method of the invention enables accurate bending to be achieved irrespective of the rail characteristics, and without the need for these characteristics to be known.

Figure 4:
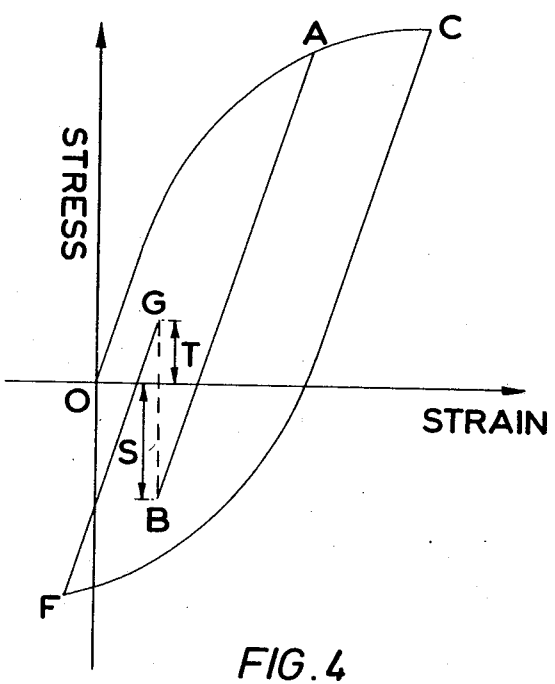
FIG. 4 is a graph corresponding to that in FIG. 3, showing stress against strain.
Figure 3:
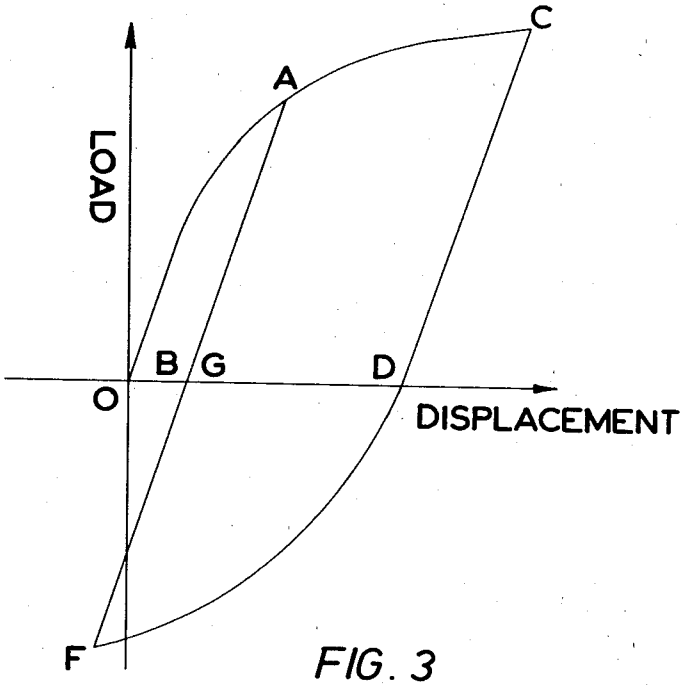
FIG. 3 is a graph showing load against displacement in the case where the material is overbent and then returned, to produce a more favourable residual stress.

Referring to FIGS. 3 and 4, a more favorable residual stress may be obtained in a material, for example in a rail, by bending beyond the desired permanent displacement, and then bending back again. The portion of the graph in FIG. 3 represented by lines OA and AB corresponds to that shown in FIG. 2. However, instead of releasing the load at point A, additional load is applied until further plastic deformation has occurred and point C on the graph has been reached. Releasing the load at this point allows the material to relax to a permanent deformation or displacement represented by point D. An opposite load is then applied to deform the material back towards the desired permanent deformation, such that when the load is released at F the material returns through relaxation of the elastic deformation to a permanent deformation represented by point G, which is the same as point B. The procedure for the application of the opposite load is the same as for the initial loading from O to C, but D now represents the new datum from which deformation is measured. The effective graph for the portion DF and FG thus becomes the same as that shown in FIG. 2. Referring particularly to FIG. 4, it can be seen that releasing the load at point A leaves, after relaxation of the elastic deformation, a residual stress at point B of S, whereas after overbending and reverse bending following the course OCFG, the residual stress is T, which is opposite in sign to S. This is especially important for applications such as railway tracks, where the residual stress S would tend to assist the rail, after the passage of further heavy traffic, in returning towards its initial downwardly bent state, whereas the opposite residual stress T tends to resist the return to the bent state.

Figure 5:
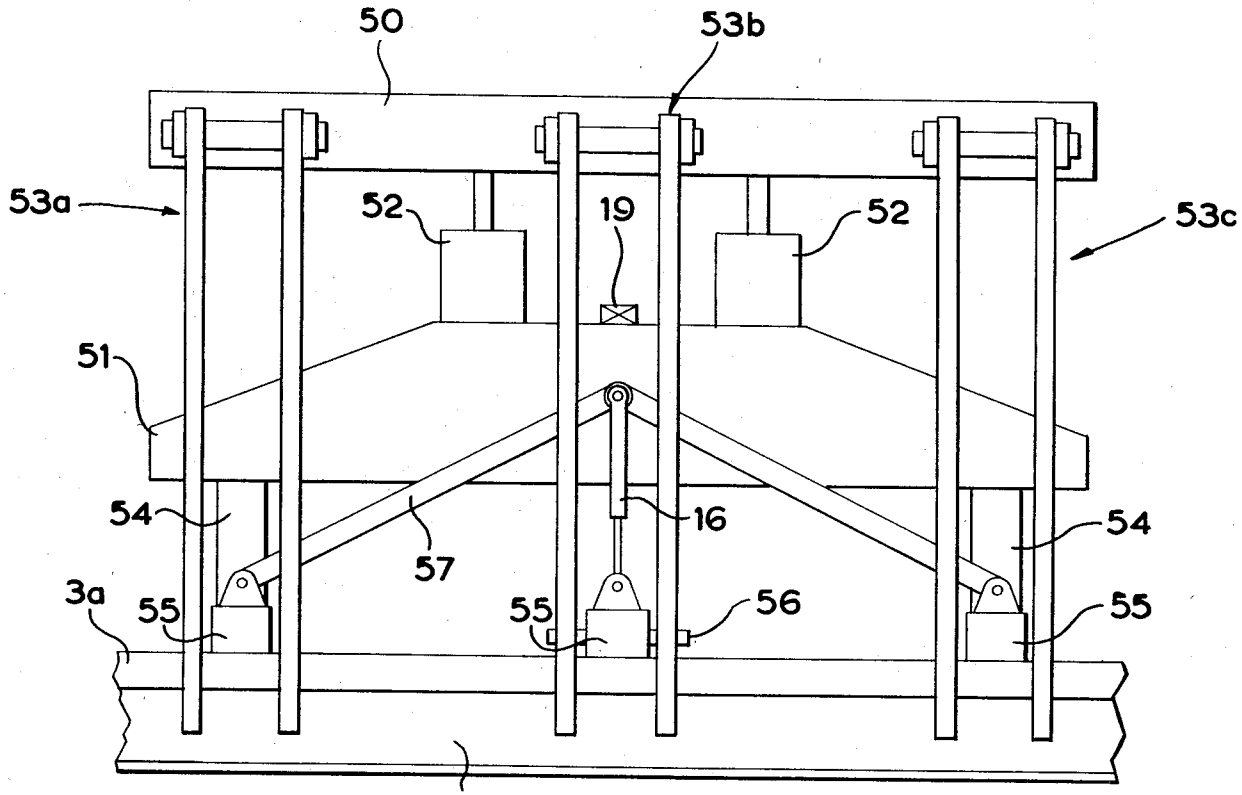
FIG. 5 is a side elevation of a second form of rail-straightening apparatus in accordance with the invention.

FIG. 5 illustrates a three-point rail-straightening apparatus which may be used to carry out the procedure described with reference to FIGS. 3 and 4. The apparatus comprises a pair of main beams 50 and 51 interconnected by a pair of vertical hydraulic rams 52. The upper beam 50 carries three pair of arms 53, each arm being pivotally mounted on the beam 50. In each case, the second arm of the pair is not shown for the sake of clarity. The second arms are pivotally mounted on the opposite side of the beam 50. The lower end of each arm 53 has an inwardly-directed hook formation which can engage on the underside of the rail head 3*a* of the rail 3.

In the configuration illustrated in FIG. 5, the apparatus is arranged to pull the center of the rail upwardly against reaction from two reaction pillars 54 inserted between the underside of the lower beam 51 and blocks 55 resting on the rail 3. The two outer pairs of arms 53*a* and 53*c* are held out of contact with the rail, while the inner pair of arms 53*b* engage the rail head 3 and are pinned to the block 55 by means of a bolt or rod 56 passed therethrough.

A measuring bridge 57 is provided between the outer blocks 55 and carries the displacement-measuring potentiometer 16, the probe of which rests on the block 55. A strain gauge 19 is mounted on the lower beam 51.

In use, the rail is drawn upwardly at the center by extending rams 52, load being transmitted through the central arms 53*b*. When a downward load is to be applied, the central arms 53*b* are disengaged from the rail 3 and a reaction pillar 54 is inserted between the beam 51 and the block 55. The outer pillars are removed and the outer arms 53*a* and 53*c* are engaged on the rail, being pinned to the blocks 55 as described previously. Extension of the rams in this configuration pushes the center downwardly relative to the outer arms.

Figure 6:
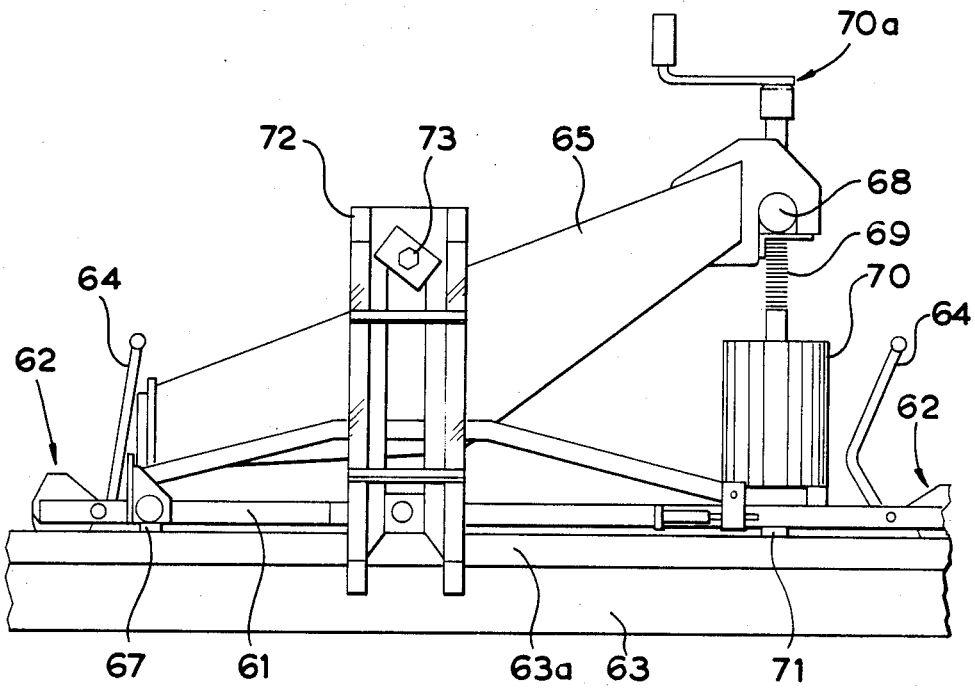
FIG. 6 is a side elevation of another form of apparatus in accordance with the invention.

Referring to FIG. 6, the three-point rail straightening apparatus comprises a support frame 61 having at each end thereof a transport roller 62 which can be pivoted onto the rail 63 by means of a handle 64, lifting the apparatus and enabling it to be drawn along the rail. The support frame 61 carries a main beam 65 which is linked to the frame 61 by pivot 66 at one end of the beam and adjacent to one of the rollers 62. The beam 65 carries a foot 67 which rests on the rail 63 when the rollers 62 are raised. At the opposite end of the main beam 65 a pivot 68 links the beam to the shaft 69 of a hydraulic jack or ram 70 carried by the frame 61. A second foot 71 beneath the ram can also rest on the rail when the adjacent roller 62 is raised, thereby transmitting force to the rail. The jack 70 has a manually-operated screw adjustment 70*a* to enable any movement to be taken up before thejack is extended.

Figure 7:
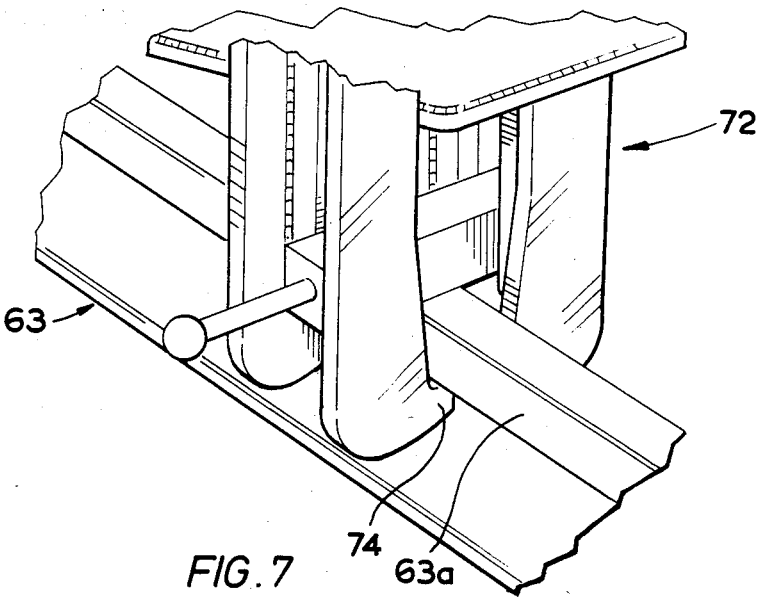
FIG. 7 is a perspective view, on an enlarged scale, of a detail of the apparatus shown in FIG. 6.

Intermediate between the two ends of the beam 65 a lifting arm 72 is carried by the beam, force being transmitted from the beam 65 to the arm 72 by means of a cross-bar 73 resting on the upper surface of the beam. The lower end of the arm 72 is formed on each side of the apparatus with a pair of inwardly-directed fingers 74 (FIG. 7) engageable beneath the rail head 63*a*, the two sides of the arm 72 co-operating to grip the rail beneath the rail-head. The two sides of the arm are initially pivotable to permit passage of the fingers over the rail-head as the arm is positioned on the apparatus. The rail can then be lifted by the arm 72, by means of the jack acting on the beam 65, against the reaction of the feet 67 and 71.

We claim:

1. A method of bending a rail forming part of a railway line to a predeterined deformation from a datum, said rail being capable of both elastic and plastic deformation, comprising:

(a) applying a load to said rail with a loading means, said loading means being at least one of three rail-engaging members, said three rail-engaging members comprising spaced first and second rail-engaging members and a third rail-engaging member therebetween and coupled by a beam, and, while said load is applied, measuring said load applied between said beam and said rail with a load measuring means; and measuring the displacement of said rail at said third rail-engaging member relative to the positions of said first and second rail-engaging members and relative to said datum, (b) establishing from said measurements a load at which said plastic component of the total deformation measured is equal to said predetermined deformation from the datum, and then removing said load.

2. A method according to claim 1, in which said load is increased continuously up to the point at which it is removed, and step (b) comprises establishing from said measurements of load and displacement obtained a linear function relating load to displacement during elastic deformation, comparing said measured displacement for each measurement of said load with the value of said displacement predicted for said measured load using the linear function, and removing said load when the difference between said measured and predicted displacements is substantially equal to the desired permanent displacement or deformation relative to said datum.

3. A method according to claim 1, in which said load is continuously measured.

4. A method according to claim 1, in which said load is periodically measured.

5. Apparatus for bending a rail forming part of a railway line to a predetermined deformation from a datum, said rail being capable of both elastic and plastic deformation, comprising:

(a) a beam having spaced first and second rail-engaging members and a third rail-engaging member therebetween coupled thereto;

(b) loading means in force transmitting relation between said beam and at least one of said rail-engaging members for applying a load between said beam and said rail;

(c) load-measuring means mounted on said beam for generating a signal representing said load applied to said beam and said rail by said loading means;

(d) displacement-measuring means mounted at said third rail-engaging member and coupled to said first and second rail engaging members for generating a signal representing said displacement of said rail at said third rail-engaging member relative to the positions of said first and second rail-engaging members and relative to said datum;

(e) sampling means electrically connected to said load-measuring-and displacement-measuring means for periodically sampling said signals generated by said measuring means;

(f) processing means electrically connected to said sampling means (i) detecting from samples supplied by said sampling means those samples which are obtained below the elastic limit for said rail, (ii) deriving therefrom a linear function relating said load to displacement under said elastic deformation, (iii) calculating for each subsequent sample using said function a predicted value of the displacement for said measured load; and (iv) generating a control signal when the difference between said measured displacement in a subsequent sample and said predicted value for said measured load in said sample is substantially equal to the predetermined deformation, and (g) control means electrically connected to said processing means responsive to said control signal to terminate the operation of said loading means.

6. Apparatus according to claim 5, in which said load-measuring means comprises a means for measuring stress in said beam.

7. Apparatus according to claim 6, in which said load measuring means comprises a strain gauge on the upper surface of said beam.

8. Apparatus according to claim 5, in which said processing means further comprises a microprocessor receiving measurements from said sampling means in the form of electrical signals and sending control signals to control the operation of said loading means.

9. Apparatus according to claim 8, in which said loading means comprises a hydraulic jack, and said control means is connected to said jack to send a control signal to release pressure in said jack when the desired deflection has been achieved.

10. Apparatus according to claim 5, in which measurements from said force- and displacement-measuring means are displayed by a display means electrically connected to said processing means.

11. Apparatus according to claim 10, in which said display means comprises an x/y plotter.

* * * * *